US007234776B2

(12) United States Patent
Laffin

(10) Patent No.: US 7,234,776 B2
(45) Date of Patent: Jun. 26, 2007

(54) BODY SUPPORT CHAIR WITH AUTOMATIC MODIFICATION OF THE BACK INCLINATION

(75) Inventor: Francois Xavier Laffin, Sion (CH)

(73) Assignee: Lifestand International SA, Sion (CH)

( * ) Notice: Subject to any disclaimer, the term of this patent is extended or adjusted under 35 U.S.C. 154(b) by 348 days.

(21) Appl. No.: 10/870,431

(22) Filed: Jun. 18, 2004

(65) Prior Publication Data

US 2005/0040688 A1 Feb. 24, 2005

(30) Foreign Application Priority Data

Jun. 19, 2003 (FR) ..... 03 07412

(51) Int. Cl.
*A61G 5/00* (2006.01)

(52) U.S. Cl. ..... 297/316; 297/330; 297/334; 297/DIG. 10; 297/321

(58) Field of Classification Search ..... 297/330, 297/DIG. 4, DIG. 10, 331, 334, 320, 321, 297/316

See application file for complete search history.

(56) References Cited

U.S. PATENT DOCUMENTS

| | | | | |
|---|---|---|---|---|
| 3,640,566 A | | 2/1972 | Hodge | |
| 3,851,917 A | | 12/1974 | Horstmann et al. | |
| 4,569,556 A | * | 2/1986 | Pillot | 297/DIG. 10 |
| 4,637,652 A | * | 1/1987 | Bergenwall | 297/DIG. 10 |
| 5,108,202 A | * | 4/1992 | Smith | 297/330 |
| 5,346,280 A | * | 9/1994 | Deumite | 297/330 |
| 5,556,121 A | * | 9/1996 | Pillot | 280/304.1 |
| 6,244,662 B1 | * | 6/2001 | Porcheron | 297/383 |
| 6,250,717 B1 | * | 6/2001 | Porcheron | 297/411.3 |
| 6,568,762 B2 | | 5/2003 | Porcheron | |
| 7,077,416 B2 | * | 7/2006 | Duarte | 280/304.1 |

FOREIGN PATENT DOCUMENTS

| | | |
|---|---|---|
| FR | 2515508 | 5/1983 |
| FR | 2724299 | 3/1996 |

OTHER PUBLICATIONS

Agrawal et al., "Optimisation of a Chair Mechanism for Partially Disabled People for Sitting-Standing and Sitting-Lying Motions", 2200 Medical & Biological Engineering & Computing, Sep. 1979, pp. 671-682.

* cited by examiner

*Primary Examiner*—Peter R. Brown
(74) *Attorney, Agent, or Firm*—Dennison, Schultz & MacDonald

(57) ABSTRACT

The body support chair for physically challenged and disabled persons comprises a frame supporting an articulated structure comprising a seat, a foot rest, a back and two symmetrical lateral systems. Each articulated system comprises a first deformable quadrilateral (17), a second deformable polygon, a back assembly and a maneuvering assembly.

The chair comprises, in addition, means (60) for automatic modification of the inclination (β) of the back of the chair with respect to the vertical direction in the sagittal plane between the lowered and verticalized positions. Figure to be published: FIG. 4)

12 Claims, 4 Drawing Sheets

BODY SUPPORT CHAIR WITH AUTOMATIC MODIFICATION OF THE BACK INCLINATION

The present invention relates to chairs and more particularly but not exclusively to wheelchairs, which are used by the physically challenged and the disabled and it includes indifferently wheel chairs, whether or not folding.

It is indisputable that wheelchairs have contributed a possibility of mobility to the physically challenged and to the disabled. These wheelchairs have, however, a number of drawbacks connected with the fact that the users can occupy only one sitting position that is otherwise maintained generally over relatively long periods.

Such a position is not simultaneously contributing to a readjustment to the present way of life and does not facilitate social interactions. In addition, such a sitting position maintained over relatively long periods is responsible for a physical deterioration such as loss of the angular amplitude of the lower extremities, perturbed blood circulation, slowing of the digestive and intestinal functions, bone fragility, etc.

In order to eliminate the aforementioned drawbacks, chairs have been proposed, whose frame supports an articulated structure comprising a back, a seat and a foot rest. Such a structure is mounted articulated by the seat onto a frontal horizontal plane, perpendicular to the vertical plane of symmetry of the frame. The articulated structure can be controlled with complete motorization or assistance for moving the seat from a lowered position to an upright position and vice versa. This type of chair is generally qualified as "body support chairs or verticalizers."

That the power source controlling or enabling control of the verticalization and lowering of the articulated structure is based on electrical energy, elastic jacks, especially gas, or purely manual, the aforementioned chair type have certainly made possible resolving to a large measure those drawbacks arising from the utilization of the classical chair.

This is certainly the reason for the success of such chairs over a number of years. By way of reference it is possible to cite the patent FR 2 529 456, which is clearly relative to this design of body support chair.

Although providing some satisfaction, this type of chair, it appears, has given rise to a comfort objection considering, in particular, the nature of the articulated structure making it possible to raise or to lower the physically challenged or disabled subject into a position of maximum safety.

In fact, the articulated feature of this structure, which can be moved from the position of the traditional chair to a position of verticalization or verticalization, wherein the different segments constituting it are substantially aligned in the extension of some others in a pseudo-vertical direction, must be kept in mind.

In order to address the anatomic exigency in the different positions capable of being occupied, the articulated structure is composed of a seat element, a back element and a foot rest element which must be occupied relative to a general position of the chair or seat type and to be placed in the extension into the verticalization or standing position.

In order to enable the verticalization-lowering movement, the articulated structure is constituted by two symmetrical lateral articulated systems, each comprising a first deformable quadrilateral contributing to the support of the seat, comprised of two sills, upper and lower, respectively, articulated on the anterior part of a frame and connected towards their rearward part by a spacer part. Each lateral articulated system comprises also a second deformable quadrilateral contributing to the support of the foot rest as well as a back assembly articulated on the first quadrilateral facing the second quadrilateral, by means of the spacer part, at least and which comprises at least one upright connected to the spacer part.

Finally, the chair comprises a maneuvering assembly interposed between the lateral assemblies and the frame and assuming the function of regulation and control of the pivoting relative to the lateral assemblies from a lowering position to a verticalization position of the structure relative to the chassis and vice versa.

Up to now, it has been considered that in the majority of cases, the comfort of the user could be assured by providing the back with an inclination relative to the vertical and identically in the lowering or seated position and in the verticalization or standing position. The lateral articulated systems have thus been designed in a way as to preserve the inclination of the back all along the movement.

However, it appeared that in certain cases, depending on the morphology or the pathology of the users, it was necessary to be able to adopt a different inclination in the upright or verticalized position and in the sitting position.

To this end, manually controlled adjusting means have been proposed and, most often, electrical motorization making it possible to modify the inclination of the back at will.

Of course, such manually controlled means for adjusting inclination are complicated to use, insofar as at any position change the user of the chair must correct the inclination of the back of the chair.

Accordingly, there is the need to avoid as well as to execute the tedious repetitive adjustment phases.

In order to achieve this object, the invention relates to a body support chair for the physically challenged and disabled comprising a frame supporting an articulated structure comprising a seat, a foot rest, a back and two symmetrical lateral articulated systems, each comprising:

- a first deformable quadrilateral contributing to the support of the seat and comprised of two sills, an upper and a lower sill, respectively, defining the greater sides of the quadrilateral and articulated on the front part of the frame defining a minor front side of the quadrilateral and connected towards their rearward parts by a spacer part defining a minor rear side of the parallelogram;
- a second deformable polygon contributing to the support of the foot rest;
- a back assembly that is articulated on the first quadrilateral opposite the second polygon by means of at least the spacer piece and which comprises at least one upright connected to the spacer piece;
- and a maneuvering assembly interposed between the lateral assembly and the frame and assuming a function of regulation and control of the relative pivoting of the lateral systems from a lowered or sitting position to a verticalized or standing position of the structure relative to the chassis and vice versa.

According to the invention, said body support chair is characterized in that it comprises, in addition, means for automatically modifying the inclination of the back relative to the vertical direction in the sagittal plane, between the lowered and upright position.

According to the invention, the means for automatic modification of inclination thus make possible either a slight rocking of the back forwards upon moving into the upright position or, in contrast, a slight rocking rearwards when moving from the sitting position to the upright position.

According to the invention, the means for automatic modification can be realized in any suitable fashion; for example, comprising a rod and return system adapted to assure said modification.

According to a preferred embodiment of the invention, the means for automatic modification of inclination comprise, for each lateral articulated system, the spacing part and the first deformable quadrilateral, which has a shape different from that of the parallelogram.

According to another feature of the invention, the means for automatic modification of inclination of the back are adjustable in such a fashion as to make possible a choice of direction and/or amplitude of the modification.

The modification means are then preferably but not necessarily adjustable in such a fashion as to have a neutral position, wherein the angle of the uprights is identical in the lowered position and in the upright position relative to the vertical in the sagittal plane.

According to a preferred but not strictly necessary characteristic of the invention, the adjustable means for automatic modification of the inclination of the back act on the shape of the first deformable quadrilateral.

In this respect, it must be noted that the utilization of the shape of the first deformable quadrilateral for the automatic modification of the inclination of the back of the chair makes it possible to achieve a simple device having a reduced weight.

According to yet another characteristic of the invention, the adjustable means for automatic modification of the inclination of the back of the chair comprise, for each articulated assembly, the spacer part on which the back is fitted in such a fashion as to form an identical angle relative to the spacer part in the upright position an din the sitting position and means for modifying the shape of the first deformable quadrilateral.

Preferably but not strictly necessary, the means for automatic modification then make it possible to select the shape of the first quadrilateral from at least the following three forms:

a parallelogram;

a quadrilateral, whose greater sides have the same length, whilst the front minor side has a length greater than that of the rear minor side;

a quadrilateral, whose greater sides have the same length, whilst the rear minor side has a length greater than that of the front minor side;

According to a preferred embodiment and in order to make possible such a modification of the shape of the first deformable quadrilateral, the spacer piece comprises at least two fixation positions for the corresponding point of articulation of the lower sill of the first parallelogram.

Preferably, the spacer piece comprises three positions for the point of articulation of the lower sill, thus conferring upon the first deformable quadrilateral, respectively, the shape:

of a parallelogram;

of a quadrilateral, whose front minor side has a length greater than that of the rear minor side;

of a quadrilateral, whose rear minor side has a length greater than that of the front minor side;

According to another feature of the invention, in order to make possible an optimum adaptation of the body support chair to the morphology of its user, the body support chair comprises also means for adjusting the angle of each upright relative to the corresponding spacer piece.

The means for adjusting the relative angle of the upright and of the spacer part can be realized in any suitable fashion.

According to a feature of the invention, the means for adjusting the angle of the upright relative to the spacer part comprise, for each upright, a pivot for fixation of the upright on the articulation part, authorizing a rotational movement of the upright between a retracted position against the upper sill of the first quadrilateral or the seat of the chair and a raised position as well as the means for locking the upright in the raised position, said means being attached to the spacer part and displaceable on same so as to permit a continuous modification of the angle between the spacer part and the upright in the raised and locked position.

In addition, a body support chair according to the invention can comprise different types of propulsion means such as electrically driven wheels or, preferably, manual propulsion wheels.

Various other features of the invention will become apparent from the description that follows made with reference to the annexed drawings, which illustrate the different non-limiting embodiments of a body support chair according to the invention and having the means for automatic modification of the inclination of the back of the chair.

Figure 1:
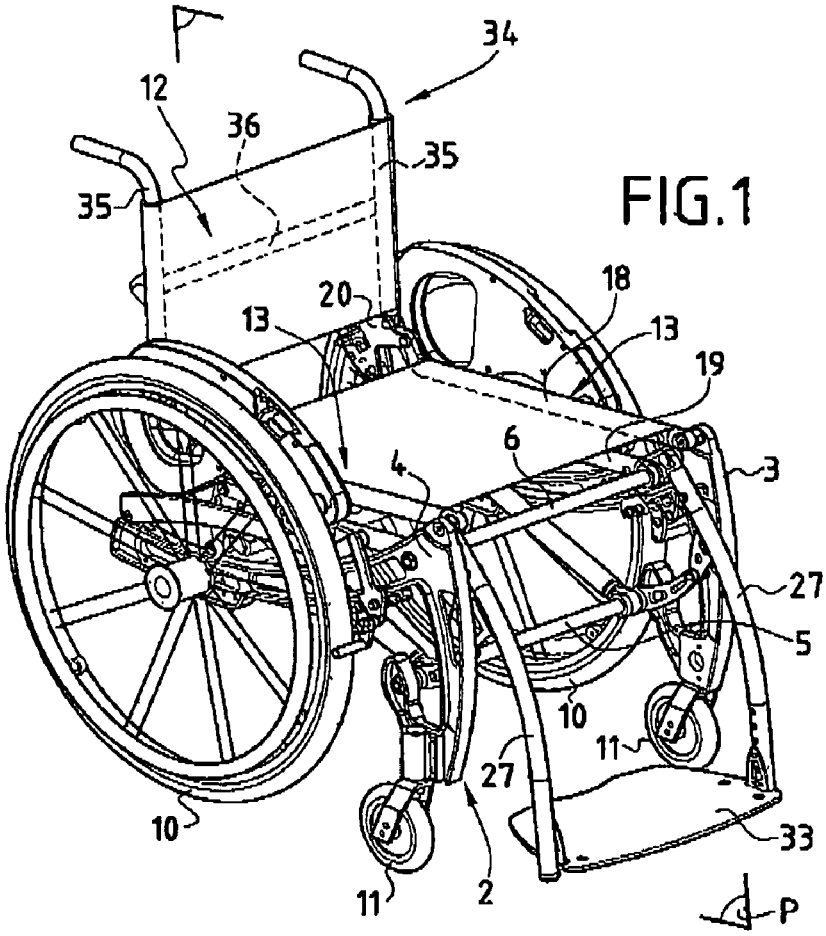
FIG. 1 represents a perspective view of a body support wheelchair according to the invention.
Figure 2:
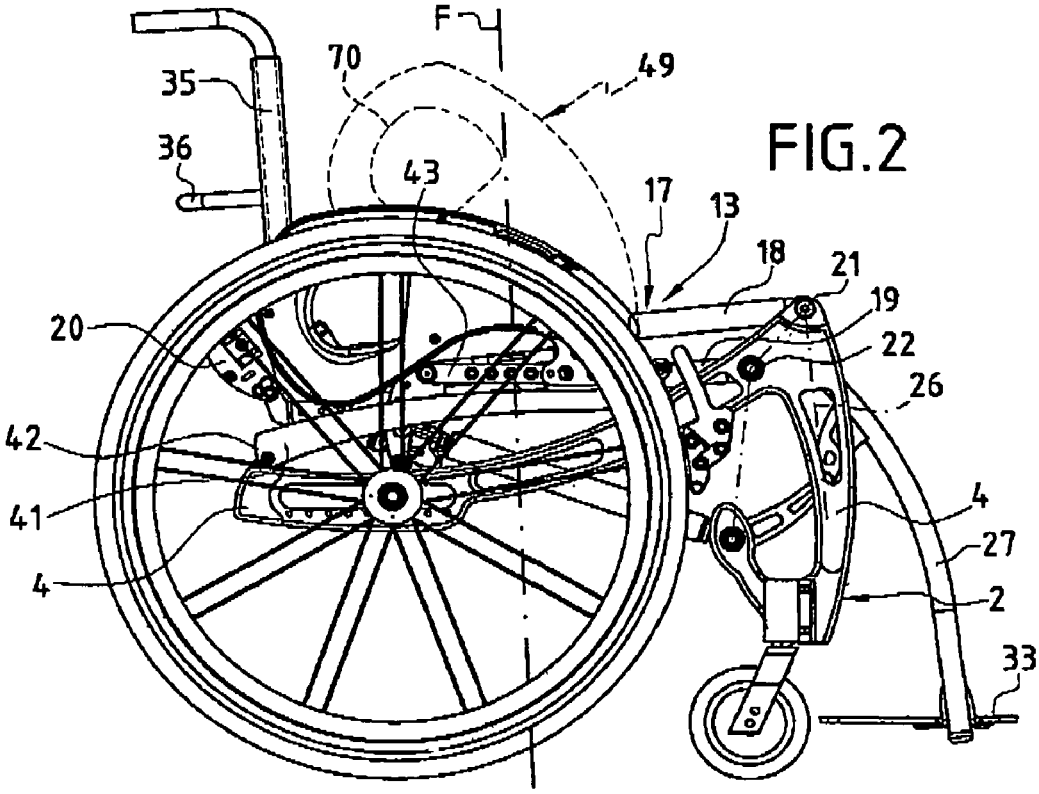
FIG. 2 represents an elevation in right-sided view of the chair illustrated in FIG. 1 in the lowered sitting position of the chair.
Figure 3:
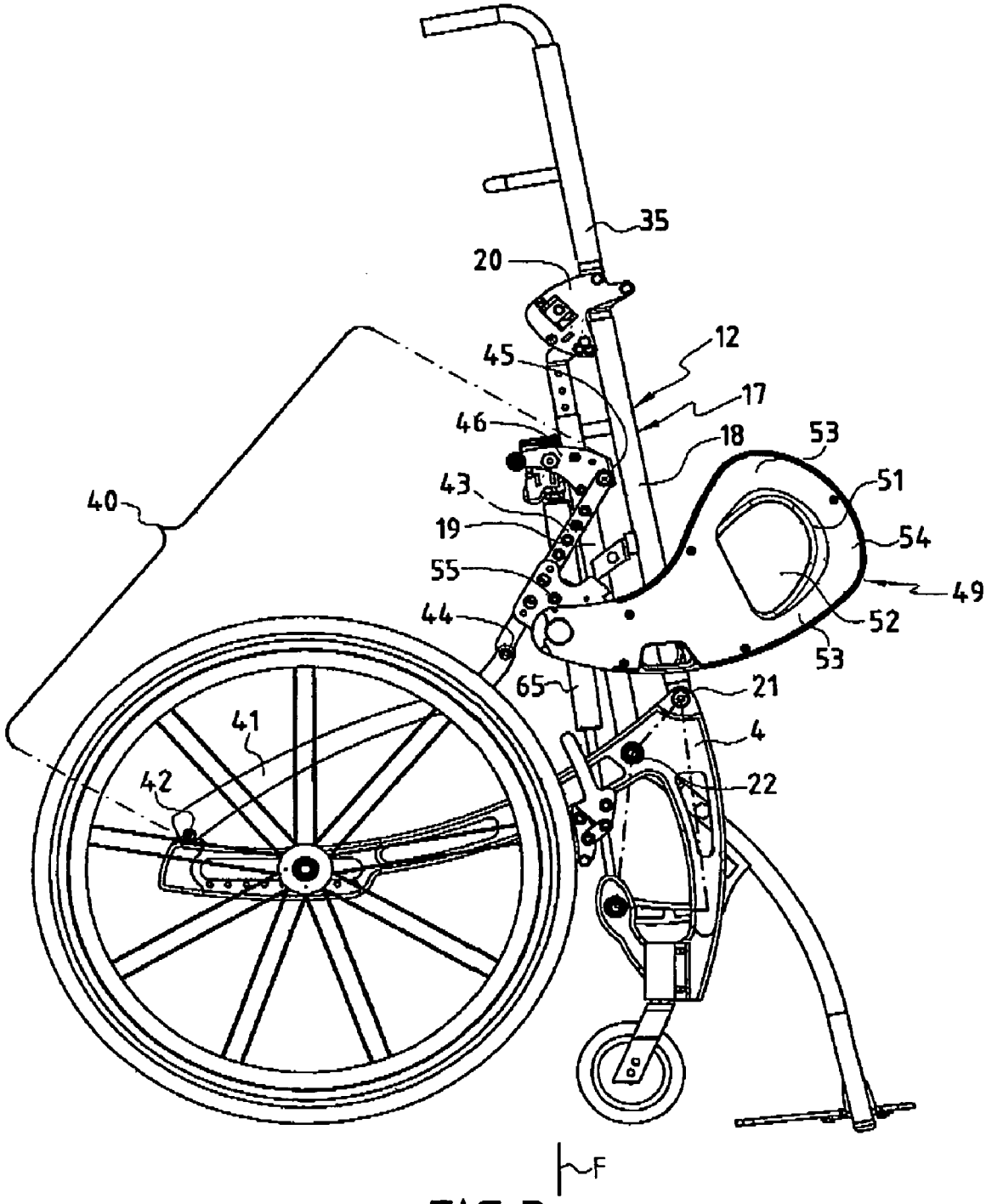
FIG. 3 represents a partial elevation, similar to FIG. 2, of the chair in the verticalization or upright position.

The invention proposes making possible an automatic modification of the inclination of the back on a body support wheelchair such as that represented in FIGS. 1 to 3 and designated in its entirety by reference 1, in order to provide the greatest possible comfort to the user of the chair.

This type of chair comprises a frame, comprised of two lateral hemi-frames 3 and 4, connected together by cross-members 5 and 6. These different constituent elements define a supporting assembly provided with driver wheels 10 and orientable steering wheels 11.

As illustrated, the frame 2 corresponds to a rigid design chair but it is quite obvious that a substantially similar conformation could be used for a foldable chair. In fact, in such a case, the rigid cross-members 5 and 6 are then replaced by flexible elements of known design.

The frame 2 described hereinbefore is equipped with a verticalizer device, which is realized in the form of an articulated structure 12 supported by the frame 2. The articulated structure 12 is comprised by two symmetrical lateral articulated systems symmetrical relative to a sagittal plane P and which are more particularly visible in FIGS. 2 and 3. Each articulated system 13 is intended to be attached laterally to the frame 2 at each of the hemi-frames 3 and 4, for example.

Each articulated system 13 comprises a first deformable quadrilateral 17 comprised of two sills 18 and 19, respectively called upper and lower, although they are not—in the representation shown in FIG. 3—disposed in the same vertical plane. The sills 18 and 19 are connected by their rear end part by a spacer element or part 20 to which they are connected by pivots $\mathbf{20}_1$, $\mathbf{20}_2$. The sills 18 and 19 are, in addition, mounted on the frame 2 in the vicinity of the frontal part of said latter by a first point of articulation 21 relating to the upper sill 18 and by a second point of articulation 22 relating to the lower sill 19. In the present case, the point of articulation 21 is provided in the upper part of the corresponding hemi-frame 3, 4, whilst the point of articulation 22 is situated on this same hemi-frame to the rear and below the point of articulation 21.

Figure 4:
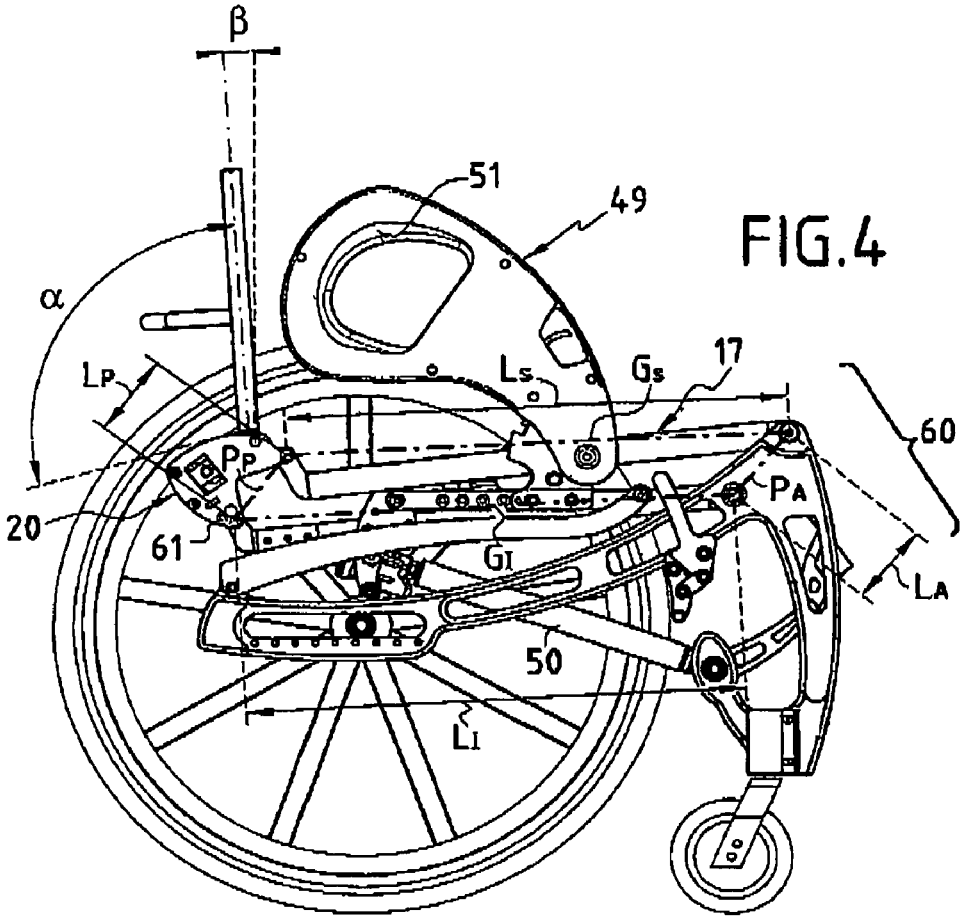
FIG. 4 represents an elevation, similar to FIG. 2, without the driver wheel, illustrating in greater detail a means for automatic modification of the inclination of the back of the chair.

Accordingly, the lower sills 19 and upper sills 16 and their respective points of articulation $\mathbf{20}_1$, 21, $\mathbf{20}_2$, 22 define the greater upper sides $G_S$ and lower sides $G_I$, whilst the spacer part 20 defines a rear minor side $P_P$ of the first quadrilateral and the points of articulation 21, 22 on the front part of the frame defining a front minor side $P_A$, as shown in FIG. 4.

Each articulated system 13 comprises in addition a second polygon according to the illustrated example a deformable quadrilateral drawn in FIGS. 2 and 3 in dotted and dashed lines, connecting the first deformable quadrilateral to a jamb or similar upright 27 intended for supporting, alone or in combination with a jamb or similar riser, a foot rest 33.

Finally, each articulated system 13 comprises a back assembly comprising two uprights 35, each of which being articulated on the first quadrilateral 13 opposite to the second quadrilateral 26 by means of the spacer part 20. According to the illustrated example, the uprights of the back 35 are in addition connected by a cross-member 36.

In order to allow passage of the articulated structure 12 from the sitting lowered position—as shown in FIG. 2—to the verticalization or upright position—as illustrated in FIG. 3—each articulated system comprises in addition a maneuvering assembly 40 interposed between the first quadrilateral 17 and the frame 2 and, more particularly, the corresponding hemi-frame 4.

Each maneuvering assembly 40 comprises a first lever 41 articulated on the rear part of the chassis by means of a pivot 42 and, at the end of a second lever 43 by means of a pivot 44. The other end of the second lever 43 is thus articulated on the first quadrilateral and, according to the illustrated example, on the lower sill 19 by means of a pivot 45 and a fixation piece 46 attached to the second lever 43.

Each maneuvering assembly comprises also a maneuvering handle 49, which could be made universal to the extent that it must allow the user of the chair to apply a force on said handle, both in terms of the lowered or sitting position shown in FIG. 2 and in terms of the verticalization B shown in FIG. 3 and during the transition or verticalization-lowering movement.

In order to facilitate the verticalization-lowering movement, the body support chair described hereinbefore also comprises assistance means 50. According to this example, the assistance means consist, for each of the articulated systems, of a gas jack 6 interposed between the first quadrilateral 13 and the front part of the frame 3.

According to the illustrated example, each gas jack 50 incorporates also automatic blocking means which prevent any movement of the jack and thus of the articulated system to which it is connected, whilst an unblocking control is not applied to the blocking system of the blocking of the jack. The handle 49, arranged alongside of the dominant hand of the user thus comprises a control member acting on the means for blocking the gas jacks 50.

By utilization of the maneuvering assemblies and the gas jacks 50, the user of the chair thus has the possibility of moving, alternatingly, from a sitting position to a standing position, depending on his needs.

In order to assure optimum comfort to the user, the invention proposes utilization of means 60 making it possible to automatically modify the inclination of the back relative to the vertical. Accordingly, it will be possible, for example, to adopt a back position slightly inclined forward or rearward, in a lowered position, whilst the back of the chair will automatically adopt a position, by way of example but not exclusively, a substantially vertical position in the verticalization or standing position of the structure in order to confer a satisfactory orientation to the user's waist [sic] in the standing position.

This automatic modification of the orientation of the back of the chair can be assured in different ways.

According to the illustrated example, the means 60 for automatically modifying the inclination of the back of the chair comprise, for each lateral articulated system, the spacer part 20 on which the corresponding upright 35 of the back is fitted, so as to form, together with said spacer part, an angle $\alpha$ that remains constant in the course of the displacements of the articulated structure. The automatic modification means 60 comprise, in addition, the first deformable quadrilateral 17 composed of two greater sides $G_S$, $G_I$ and minor sides $P_B$, $P_A$. In order to allow an automatic modification of the inclination $\beta$ of the back of the chair or of the uprights 35 relative to the vertical V, the applicant has had the opportunity to show that a slight modification of the deformable quadrilateral 17 relative to the perfect parallelogram makes it possible to obtain a variation in the inclination $\beta$ between the lowered or sitting positions and the verticalization or standing position of the articulated structure.

Accordingly, the applicant proposes adopting a shape different from that of the parallelogram for the first quadrilateral in order to obtain such automatic modification.

According to the illustrated example, the form chosen for the first deformable quadrilateral is adopted in such a fashion that the greater sides $G_S$ and $G_I$ have equal lengths $L_S$ and $L_I$, whilst the length $L_A$ of the front minor side $P_A$ is chosen so as to be greater than the length $L_P$ of the rear minor side $P_P$. This configuration of the first deformable quadrilateral thus allows one to obtain a displacement towards the rear of the back of the chair at the time of moving from the sitting position to the standing position.

According to the illustrated example, the means 60 for automatic modification are adjustable and it is possible to choose three different lengths for the rear minor side $P_P$ of the quadrilateral. To this end, the spacer part has three holes 61 hat are arranged in a triangle and which make it possible to choose the shape of the first deformable quadrilateral from the following three shapes:

- a parallelogram;
- the rear side $P_P$ having a length $L_P$ greater than that of $L_A$ of the front minor side $P_A$;
- the rear side $P_P$ having a length $L_P$ less than that of $L_A$ of the front minor side $P_A$;

The choice of the shape of the parallelogram thus corresponds to a neutral adjustment, for which the amplitude of modification of the inclination of the back of the chair between the lowered position and the verticalized position is zero, said latter preserving the same inclination $\beta$.

In contrast, when the rear minor side $P_P$ has a length greater than that of the front minor side $P_A$, the back of the chair will tend to incline towards the front at the time of moving from the lowered position to the verticalization position. In contrast, when the minor side $P_P$ has a length less than that of the front minor side $P_A$, the back of the chair will tend to incline towards the rear at the time of moving from the lowered position to the verticalization position.

Always in terms of optimum comfort for the user of the body support chair 1, said latter comprises preferably but not strictly necessarily means 70 for adjusting the angle α between each upright of the back 35 and the corresponding spacer part 20.

Figure 5:
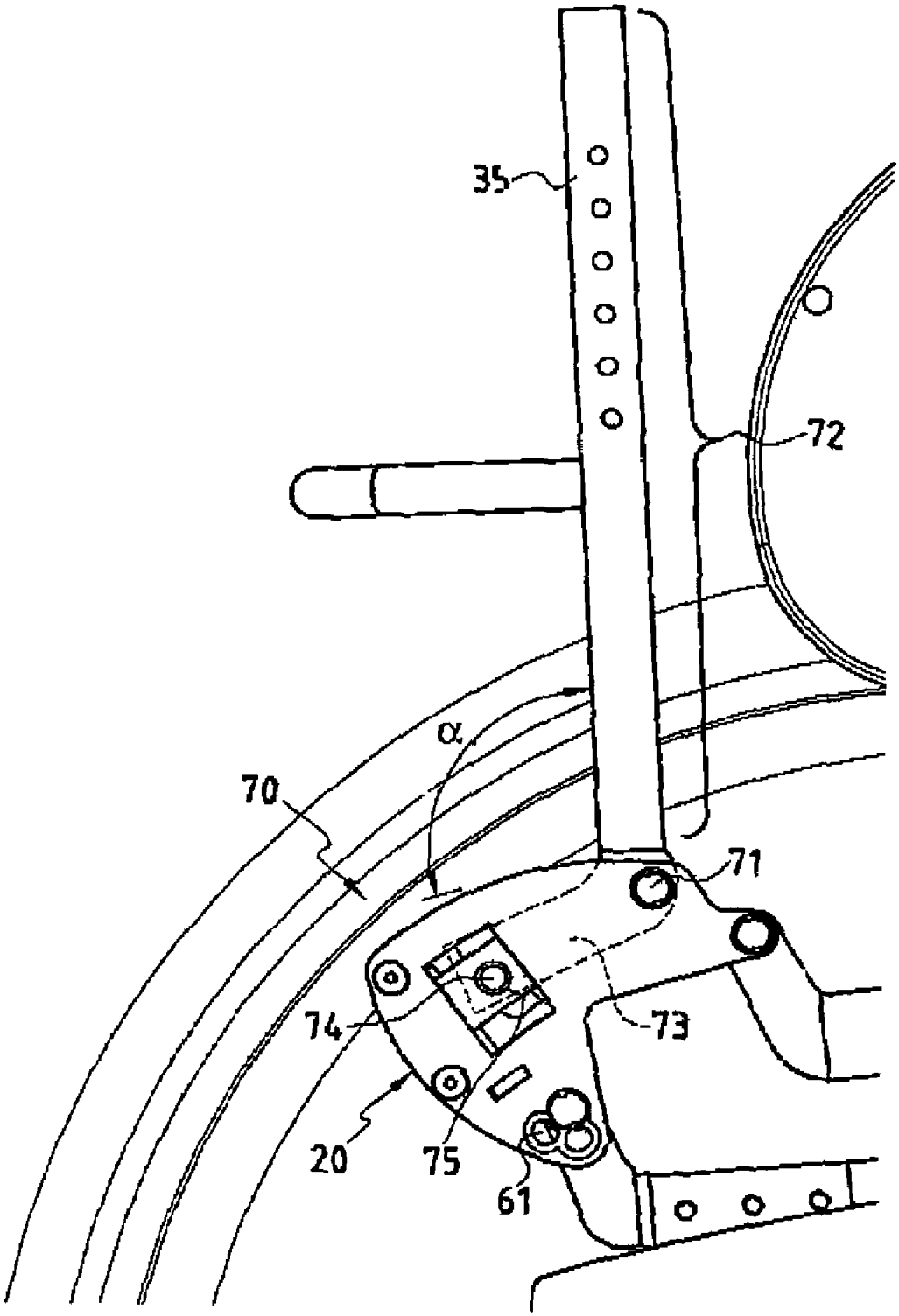
FIG. 5 is a partial elevation, similar to FIG. 4, showing in greater scale, the means for adjusting the angle of the back relative to a part supporting it.

The adjusting means 70 can be realized in any suitable fashion. According to the embodiment of the chair illustrated and described hereinbefore and as will become more completely apparent from FIG. 5, the adjusting means comprise, for each lateral articulated system, a pivot 71 for fixation of the upright of the back 35 on the spacer part so that the upright 35 has, facing its for each lateral articulated system back support part 72, a locking segment 73.

Considering its fixation by means of the pivot 71, the upright of the back 35 is thus mobile between a retracted position against the upper sill of the first deformable quadrilateral or the seat of the body support chair and a raised position for utilization of the body support chair 1.

The means for adjusting the inclination 70 thus comprise, in addition, the means for locking the upright 35 and, more particularly, of its segment 73 in the raised position so that the upright 35 is immobilized relative to the spacer part 20. The locking means comprise a finger 74 attached to the locking segment 73 and a type of plate 75 attached to the spacer part 20, while being mobile relative to said latter so as to make possible, in virtue of its displacement, a modification, preferably continuous, of the angle α. To this end, the plate can, for example, be mounted in a groove while being displaced in translation by means of an Archimedes screw.

The combination of the means 70 for adjusting the static inclination α of the upright 35 relative to the spacer part 20 and the means 60 for automatically modifying the inclination of the back of the chair between the lowered position and the verticalization position thus make it possible to provide optimum comfort to the user of the chair by allowing fine adjustments of inclination of the back of the chair and, in particular, by making it possible to locate an inclination for the back of the chair that is at once optimum in the sitting and in the standing position.

According to the exemplary embodiment hereinbefore described, the adjusting means 60 for automatic modification of the inclination β of the chair between the sitting position and the standing position are realized by acting on the length $L_P$ of the rear minor side $P_P$ of the first deformable quadrilateral.

However, the adjustable means 60 for automatic modification can be realized by acting on another side of the deformable quadrilateral.

Figure 6:
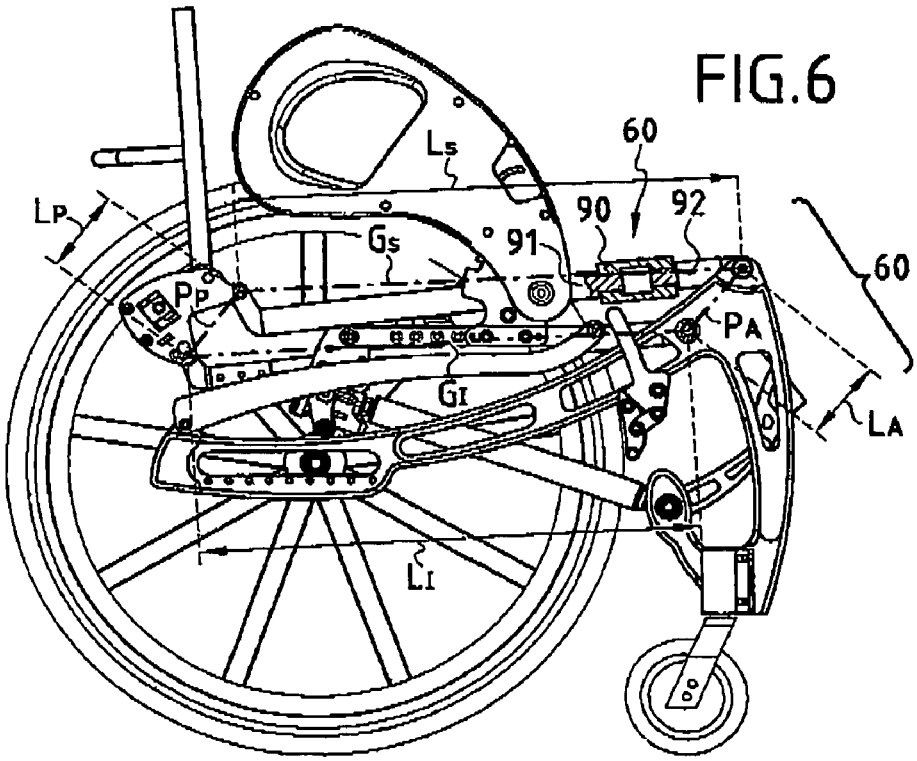
FIG. 6 represents a view, similar to FIG. 4, showing another embodiment of the adjustable means for automatic modification of the inclination of the back of the chair.

Accordingly, FIG. 6 illustrates another embodiment according to which the means 60 for modifying the form of the first adjustable quadrilateral consist of the means for continuous modification of the length of the upper sill 18 of the first deformable quadrilateral. Said means 60 of continuous modification are, according to the illustrated example, comprised of a right 90 connecting two constituent segments 91, 92 of the sill 18 and connected to each of said segments by a threaded part so that a rotation of the ring in one direction makes possible an increase in the length $L_S$ of the upper segment 18 and, in the reverse direction, a reduction of the length $L_S$ of the upper segment 18.

Thus, as a function of the desired length, it is possible, by means of the ring 90, to act both on the direction of modification of the inclination β of the back of the chair and on the value or amplitude of said modification.

Obviously, various other modifications can be made to the invention without departing from its scope.

The invention claimed is:

1. A body support chair for physically challenged and disabled persons comprising a frame supporting an articulated structure, which comprises a seat, a foot rest, a back, as well as two symmetrical lateral articulated systems, each system comprising:

a first deformable quadrilateral contributing to support of the seat, comprising an upper sill and a lower sill defining two great sides of the quadrilateral, articulated on a front part of the frame corresponding to a front minor side of the quadrilateral and connected towards their back parts by a spacer part corresponding to a minor rear side of the quadrilateral;

a second deformable polygon contributing to the support of the foot rest and connected to a front part of the first quadrilateral and the frame;

a back assembly that is articulated on the first quadrilateral opposite the second polygon by means of at least the spacer part, and which comprises at least one upright connected to the spacer part;

a maneuvering assembly interposed between the lateral systems and the frame, and constructed and arranged to regulate and control relative pivoting of the lateral systems from a lowered position to a verticalized position of the structure relative to the frame and vice versa; and means for automatic modification of inclination angle (β) of the back of the chair with respect to the vertical direction in a sagittal plane, the means for automatic modification comprising the spacer parts and/or the first quadrilaterals and being adapted to induce a modification of the inclination when the lateral systems are moved from the lowered position to the verticalized position.

2. A body support chair according to claim 1, wherein the means for automatic modification of the inclination comprises, for each lateral articulated system, the spacer part and the first quadrilateral which has a shape different from that of a parallelogram.

3. A body support chair according to claim 2, wherein the means for automatic modification of the inclination is adapted to modify the shape of the first deformable quadrilateral of each system.

4. A body support chair according to claim 3, where the means for automatic modification of the inclination comprises means for modifying the length of the upper sills of the first quadrilaterals.

5. A body support chair according to claim 3, wherein the means for automatic modification of the inclination are adapted to make possible a choice of direction and/or amplitude of the modification of the inclination when the lateral articulated systems are moved from the lowered position to the verticalized position by choosing the shape of the first quadrilaterals.

6. A body support chair according to claim 3, wherein the means for automatic modification of the inclination are constructed and arranged to have a neutral position, wherein the angle (β) of the uprights is identical in the lowered position and in the verticalized position relative to the vertical, in the sagittal plane.

7. A body support chair according to claim 1, wherein the means for automatic modification of the inclination comprises:

the spacer parts, on which the upright of the back of the chair is fitted so as to form an identical angle relative to the spacer part in the verticalized position and in the lowered position; and means for modifying the shape of the first deformable quadrilateral.

8. A body support chair according to claim 7, wherein the means for modifying the shape of the first deformable quadrilateral is adapted to permit a choice of the form of the first quadrilaterals from at least three forms selected from the group consisting of:

a parallelogram;

a quadrilateral, having the great sides of same length, where the front minor side has a length greater than that of the rear minor side; and a quadrilateral, having the great sides of same length, where the rear minor side has a length greater than that of the front minor side.

9. A body support chair according to claim 7, wherein the means for modifying the shape of the first deformable quadrilateral comprises pivots connecting the rear end of each of the lower sills to the corresponding spacer part and at least two positions of fixation for the pivots on each of the spacer parts.

10. A body support chair according to claim 9, wherein the spacer part comprises three positions of fixation for the pivots conferring upon the first deformable quadrilaterals the shape, respectively:

of a parallelogram;

of a quadrilateral, having the front minor side of a length greater than that of the rear minor side;

of a quadrilateral, having the rear minor side of a length greater than that of the front minor side.

11. A body support chair according to claim 1, additionally comprising means for adjusting the angle of each upright relative to the corresponding spacer part.

12. A body support chair according to claim 11, wherein the adjustment means for each upright comprises:

a fixation pivot of the upright on the spacer part permitting a rotational movement of the upright between a retracted position against the upper sill of the first quadrilateral and a raised position; and means for locking the upright in the raised position, which means are attached to and mobile on the spacer part, so as to enable continuous modification of the angle ($\alpha$) between the upright and the spacer part.

* * * * *